US008646838B2

(12) United States Patent
Fiore, Jr. et al.

(10) Patent No.: US 8,646,838 B2
(45) Date of Patent: Feb. 11, 2014

(54) CHILD BOOSTER SEAT

(75) Inventors: Joseph F. Fiore, Jr., Lebanon, PA (US); Curtis M. Hartenstine, Birdsboro, PA (US); Zhang Shao-Yue, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 622 days.

(21) Appl. No.: 12/730,791

(22) Filed: Mar. 24, 2010

(65) Prior Publication Data

US 2010/0244516 A1 Sep. 30, 2010

Related U.S. Application Data

(60) Provisional application No. 61/210,997, filed on Mar. 25, 2009.

(30) Foreign Application Priority Data

Oct. 26, 2009 (CN) ..... 2009 1 0206653

(51) Int. Cl.
*A47C 1/11* (2006.01)
*A47C 1/08* (2006.01)

(52) U.S. Cl.
USPC ..... 297/250.1

(58) Field of Classification Search
USPC ..... 297/250.1, 475, 484
See application file for complete search history.

(56) References Cited

U.S. PATENT DOCUMENTS

| | | | | |
|---|---|---|---|---|
| 1,739,366 | A | 12/1929 | Lang | |
| 1,967,533 | A | 7/1934 | Koop | |
| 4,324,430 | A * | 4/1982 | Dimas et al. | 297/256.17 |
| 4,598,945 | A * | 7/1986 | Hopkins | 297/256.17 |
| 4,854,638 | A * | 8/1989 | Marcus et al. | 297/256.11 |
| 4,912,818 | A * | 4/1990 | Meeker | 24/170 |
| 5,183,311 | A * | 2/1993 | Meeker et al. | 297/151 |
| 5,630,645 | A * | 5/1997 | Lumley et al. | 297/250.1 |
| 6,033,019 | A * | 3/2000 | Hession-Kunz et al. | 297/250.1 |
| 6,343,837 | B1 * | 2/2002 | Gage | 297/250.1 |
| 6,543,846 | B2 * | 4/2003 | Cone | 297/250.1 |
| 6,692,072 | B2 | 2/2004 | Nelson et al. | |
| 6,832,813 | B2 | 12/2004 | Tomas et al. | |
| 2002/0043836 | A1 * | 4/2002 | Maciejczyk et al. | 297/250.1 |

FOREIGN PATENT DOCUMENTS

| | | | | |
|---|---|---|---|---|
| WO | WO 8602050 A1 * | 4/1986 | | B60N 1/12 |

* cited by examiner

*Primary Examiner* — David R Dunn
*Assistant Examiner* — Tania Abraham
(74) *Attorney, Agent, or Firm* — Merchant & Gould P.C.

(57) ABSTRACT

A child booster seat includes a seat body having a cavity wall that confines a receiving cavity and that is formed with an opening. The child booster seat further includes a strap including a first end segment and a second end segment, and a coupling member attached to the second end segment. The strap is configured to couple with the seat body in a manner that the first end segment is retained in the receiving cavity and the second end segment is disposed to be extended through the opening in the seat body to dispose the first coupling member outwardly of the receiving cavity. The coupling member is connected releasably to the seat body so that the strap is operable to bind the seat body to the chair.

20 Claims, 11 Drawing Sheets

CHILD BOOSTER SEAT

CROSS-REFERENCE TO RELATED APPLICATIONS

This application claims priority of U.S. provisional application No. 61/210,997, filed on Mar. 25, 2009, and Chinese application no. 200910206653.4, filed on Oct. 26, 2009.

BACKGROUND OF THE INVENTION

1. Field of the Invention

The invention relates to a child booster seat, more particularly to a child booster seat adapted to beheld to a chair.

2. Description of the Related Art

U.S. Pat. No. 6,832,813, U.S. Pat. No. 5,183,311A, U.S. Pat. No. 1,967,533A, U.S. Pat. No. 1,739,366A, and U.S. Pat. No. 6,692,072B2 disclose various child booster seats with straps for binding to a chair. However, use of the disclosed child booster seats may involve inconvenient or exposed strap operation that make it more difficult to reliably bind a child booster seat to a chair part, such as in a confined space or in areas with significant movement near the child booster seat. However, apart from the functionality of binding a juvenile safety seat to a chair, the storage of the straps and convenience of storing the straps should also be taken into consideration for such designs. Accordingly, improvements may be made with respect to the design and operation of a child booster seat with straps.

SUMMARY OF THE INVENTION

Therefore, the main object of the present invention is to provide a child booster seat with convenient and reliable strap operation.

Accordingly, a child booster seat of an embodiment of the present invention comprises a seat body having a cavity wall that confines a receiving cavity and that is formed with a first opening. The child booster seat further comprises a first strap including a first end segment and a second end segment, a first coupling member attached to the second end segment.

The first strap is configured to couple with the seat body in a manner that the first end segment is retained in the receiving cavity and that the second end segment is disposed to be extended through the first opening in the seat body to dispose the first coupling member outwardly of the receiving cavity. The first coupling member is connected releasably to the seat body so that the first strap is operable to bind the seat body relative to the chair part.

The child booster seat further comprises a first brake mechanism mounted to the seat body and configured to engage the first strap for arresting movement of the first strap relative to the seat body.

An advantage of this invention includes the operation of the child booster seat, such that when the first coupling member engages releasably the seat body, the first strap extends on one side of a chair part, and the first brake mechanism engages the first strap for arresting movement of the first strap relative to the seat body, the seat body is permitted to be held tightly against the chair part via the first strap.

In an embodiment of the invention, the first brake mechanism includes a first operating component mounted pivotably in the receiving cavity to the seat body, the first operating component having a cam portion. The first middle segment of the first strap passes between the cam portion of the first brake mechanism and the cavity wall of the seat body. The first operating component is operable between a clamping position where the cam portion clamps the first middle segment of the first strap against the cavity wall of the seat body to arrest movement of the first end segment toward the first opening, and a releasing position where the cam portion permits movement of the first middle segment of the first strap through the first opening.

In an embodiment of the invention, the first operating component is converted to the clamping position when a pulling force is applied at the second end segment of the first strap.

In an embodiment of the invention, the first brake mechanism further includes a first pivot base mounted in the receiving cavity to pivotably support the first operating component.

In an embodiment of the invention, the first brake mechanism further includes a first biasing member that biases the first operating component to the clamping position.

In an embodiment of the invention, the first brake mechanism includes a slider seat mounted in the receiving cavity, and a slider rod mounted slidably to the slider seat. The slider seat has an end wall formed with a strap slot, and the first middle segment of the first strap is looped around the slider rod and passed through the strap slot.

In an embodiment of the invention, the slider seat includes a slider wall coupled to the end wall of the slider seat and formed with a slider groove with a near end and a far end that are respectively proximate to and distal from the strap slot. The slider rod extends into the slider groove and is slidable along the slider groove between the near end and the far end.

In an embodiment of the invention, the first brake mechanism is formed with an embedding groove for embedding removably a part of the first middle segment of the first strap therein.

In an embodiment of the invention, the first brake mechanism includes a columnar operating portion and a restriction wall provided on the seat body adjacent to the operating portion. The operating portion cooperates with the restriction wall to define the embedding groove.

In an embodiment of the invention, the cavity wall is further formed with a second opening and the child booster seat further comprises a second strap including a third end segment, a fourth end segment, a second middle segment between the third end segment and the fourth end segment, and a second coupling member attached to the fourth end segment.

The second strap is configured to couple with the seat body in a manner such that the third end segment is disposed to be received in the receiving cavity and that the second middle segment is disposed to be extended through the second opening in the seat body to dispose the second coupling member outwardly of the receiving cavity. The second coupling member is configured to engage releasably the seat body, and the second middle segment of the second strap is operable to extend on one side of another chair part of the chair for holding the seat body against the another chair part.

The child booster seat further comprises a second brake mechanism mounted to the seat body and operable to engage the second strap for arresting movement of the second strap relative to the seat body, thereby permitting the seat body to beheld tightly against the another chair part via the second strap.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
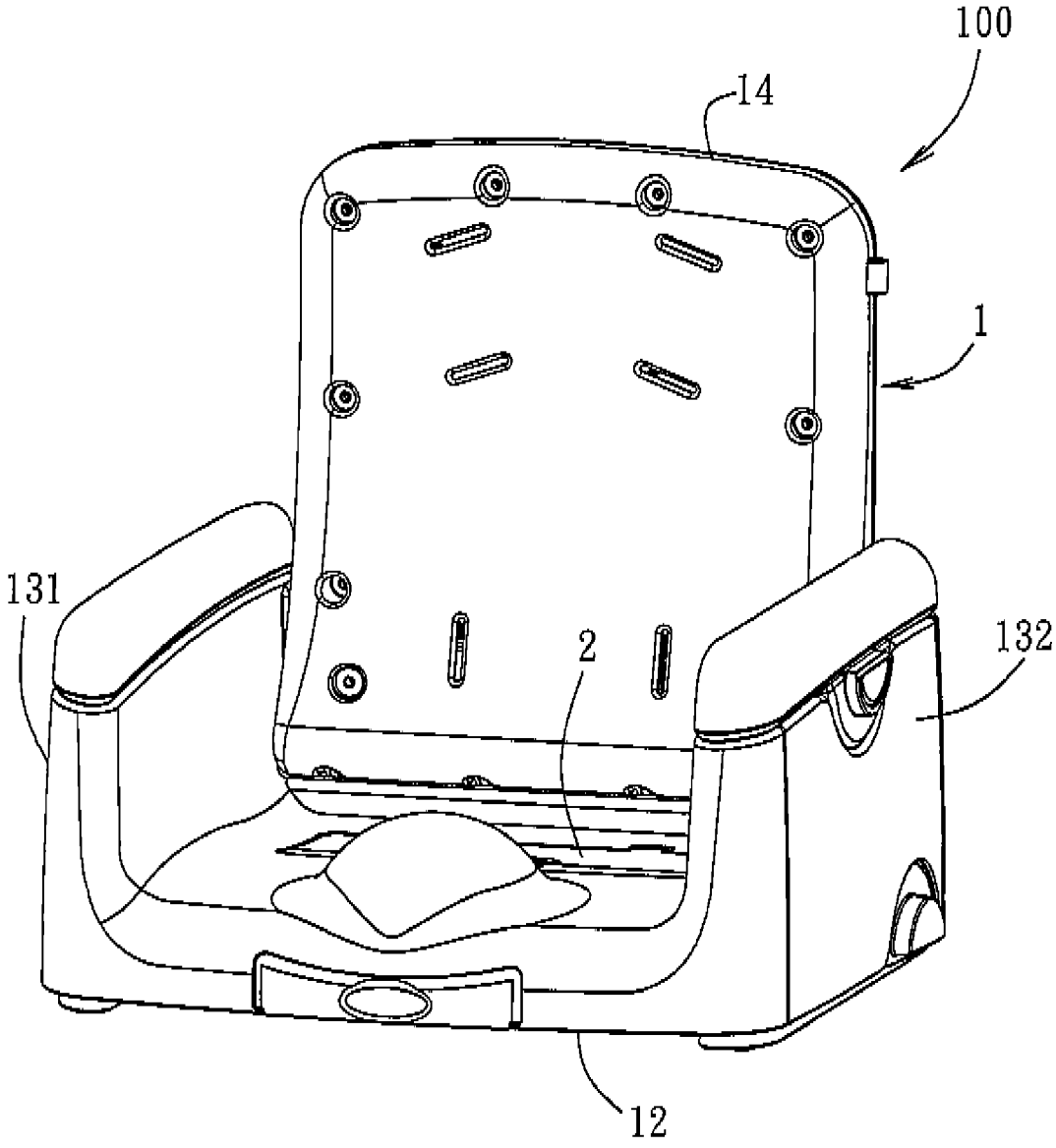
FIG. 1 is a perspective view of a child booster seat, according to the first preferred embodiment of the present invention.

Referring to FIGS. 1 to 3, and 6, the first preferred embodiment of a child booster seat 100 according to the present invention is shown to include a seat body 1, a cover 2, a first strap 32 and a second strap 42. In this embodiment, the first strap 32 is extended around a seat part 51 of a chair 5, and the second strap 42 is extended around a back part 52 of the chair 5, thus binding the seat body 1 to respective chair parts of the chair 5.

The seat body 1 is formed with a receiving cavity 11 having a cavity wall 111 formed with a first opening 112 and a second opening 113. The seat body 1 includes a seat member 12, a backrest member 14 extending upwardly from the rear of the seat member 12, and first and second side members 131 and 132 extending from respective lateral sides of the seat member 12. The seat member 12 further includes a bottom formed with a first hole 15 located near the second side member 132 of the seat body 1.

In an embodiment, the seat body 1 includes an upper housing part 17 and a lower housing part 18. The upper housing part 17 defines the top side of the seat body 1, and the lower housing part 18 defines the bottom side of the seat body 1. The backrest member 14 extends upward from the upper housing part 17. The upper housing part 17 can be moved up and down relative to the lower housing part 16 to adjust height of the child booster seat 100. The receiving cavity 11 is formed in the upper housing part 17, and the first hole 15 is formed in the lower housing part 18.

The cover 2 is mounted pivotably on top of the seat member 12 and can be lifted to gain access to the receiving cavity 11 or lowered to close the receiving cavity 11. When the cover 2 is closed, the cover 2 is substantially flush with the top face of the seat member 12 to provide a comfortable seat for a child. Additional structures may be implemented between the cover 2 and the seat body 1 to provide support, alignment, or a fastening mechanism, such as a rib part and a corresponding engaging slot that are engaged when the cover 2 is closed.

Referring to FIGS. 2 to 6, the child booster seat 100 further includes a first anchor portion 31, a first coupling member 33 and a first brake mechanism 30, all operable with the first strap 32. The first anchor portion 31 is mounted on a side of the seat body 1 that corresponds to the first side member 131 and has a rod structure in this embodiment. The child booster seat 100 also includes a second anchor portion 41, a second coupling member 43 and a second brake mechanism 40, all operable with the second strap 42. The second anchor portion 41 is mounted near a rear side of the first side member 131 of the seat body 1 and has a rod structure in this embodiment.

Figure 4A:
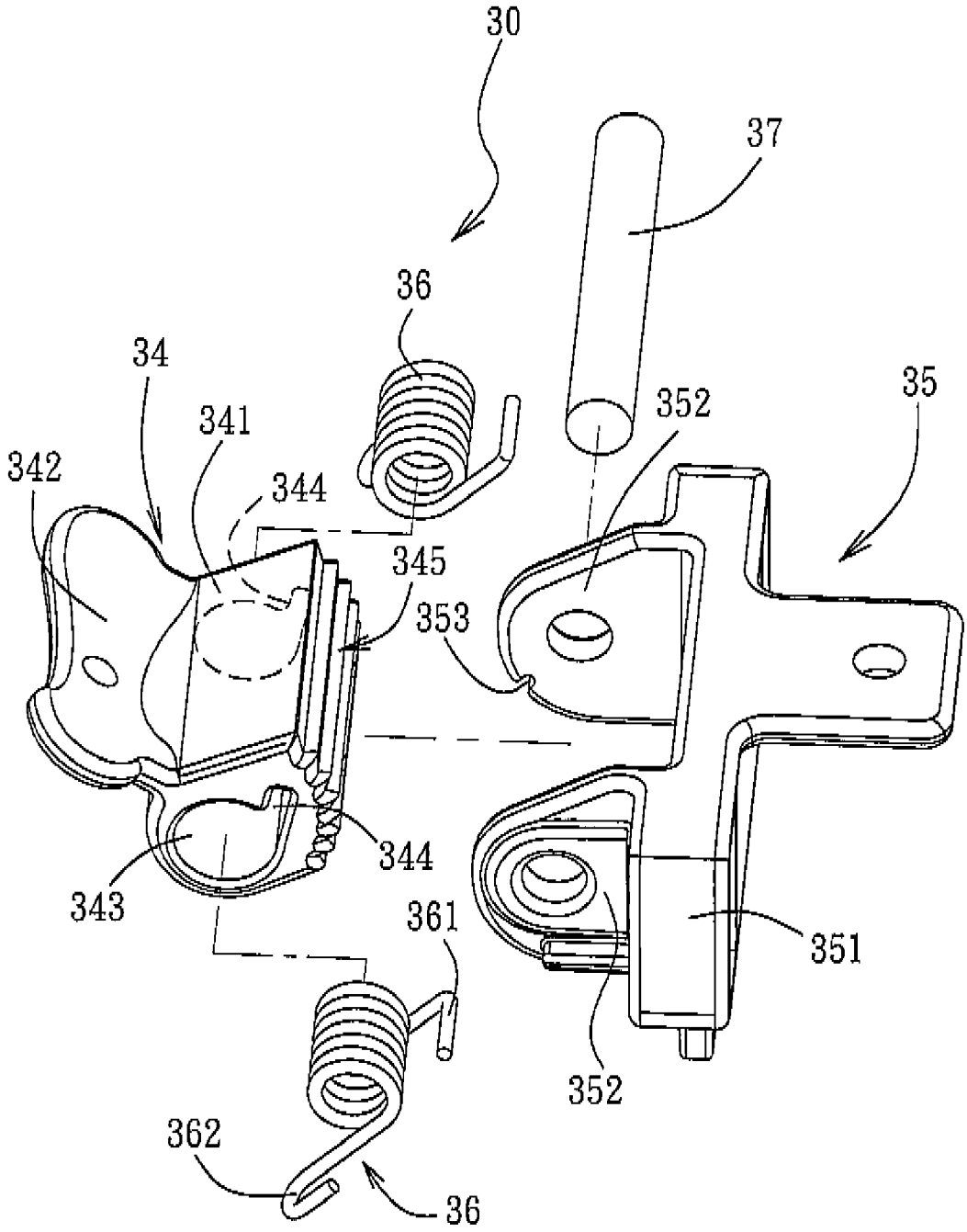
FIGS. 4A and 4B are exploded perspective views of first and second brake mechanisms, according to the first preferred embodiment.
Figure 4B:
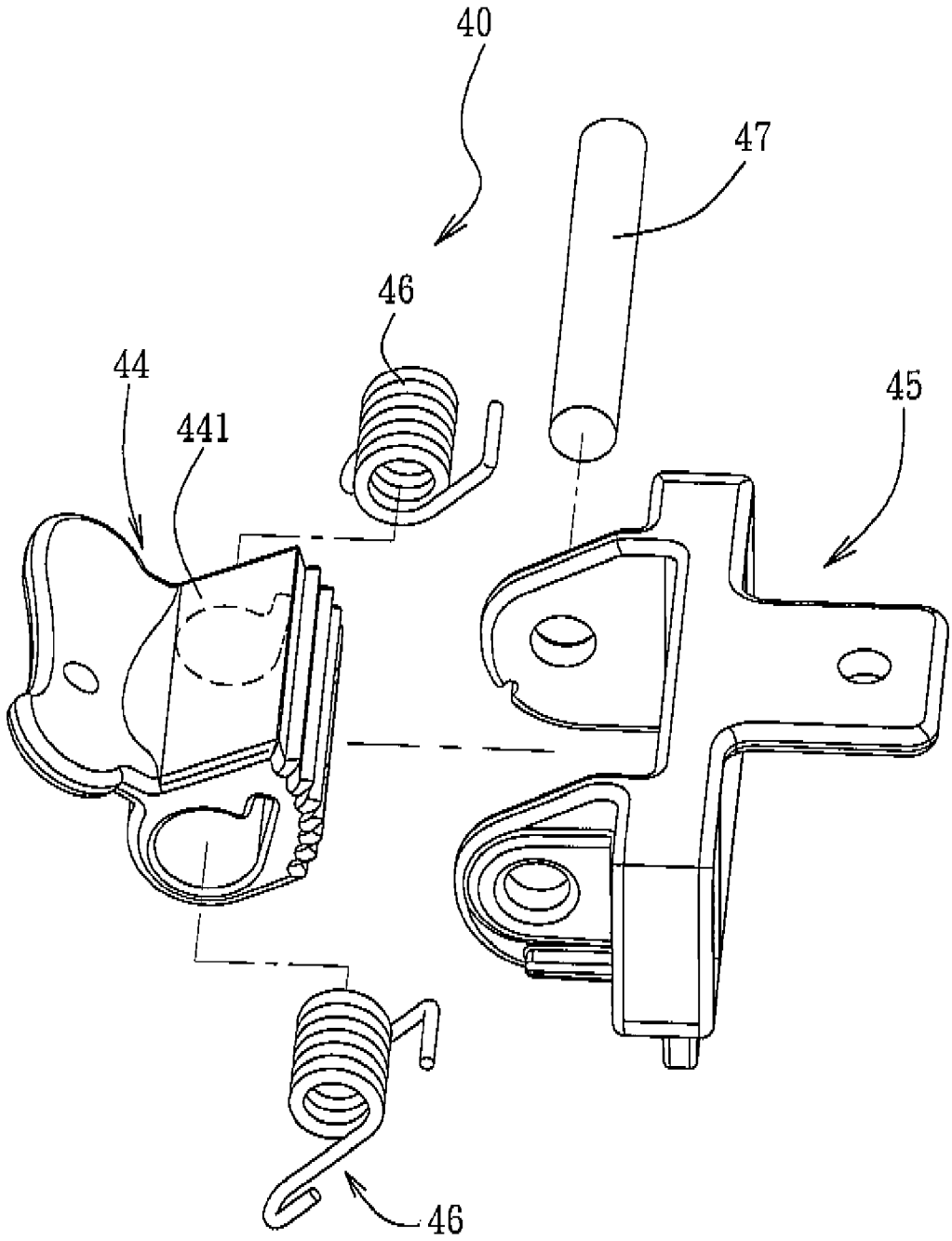

As illustrated in FIG. 4A, the first brake mechanism 30 includes a first operating component 34, a first pivot base 35, a pair of first biasing members 36, and a first pivot axle 37. As illustrated in FIG. 4B, the second brake mechanism 90 is identical in construction to the first brake mechanism 30 and includes a second operating component 44, a second pivot base 45, a pair of second biasing members 46, and a second pivot axle 47.

The first pivot base 35 is mounted fixedly to the seat body 1 in the receiving cavity 11, and is disposed adjacent to the first opening 112. The first pivot base 35 has a base plate 351 and a pair of pivot connection lugs 352 spaced apart and extending in the same direction from a side surface of the base plate 351. The first pivot base 35 is mounted fixedly to the cavity wall 111 of the receiving cavity 11 such that the pivot connection lugs 352 are disposed within the receiving cavity 11.

The first operating component 34 has a cam portion 341 and an extension portion 342 connected to the cam portion 341. The cam portion 341 is formed with a pivot connection hole 343 and a pair of positioning slots 344. The cam portion 341 further includes a teethed contact surface 345 for contacting the first strap 32. The positioning slots 344 are disposed at the two ends of the pivot connection hole 343, and are in spatial communication with the pivot connection hole 343. The function of the positioning slots 344 is discussed in greater detail below. The cam portion 341 of the first operating component 34 is pivotably connected with the first pivot base 35 by extending the first pivot axle 37 through the pivot connection lugs 352 and the pivot connection hole 343.

Figure 5:
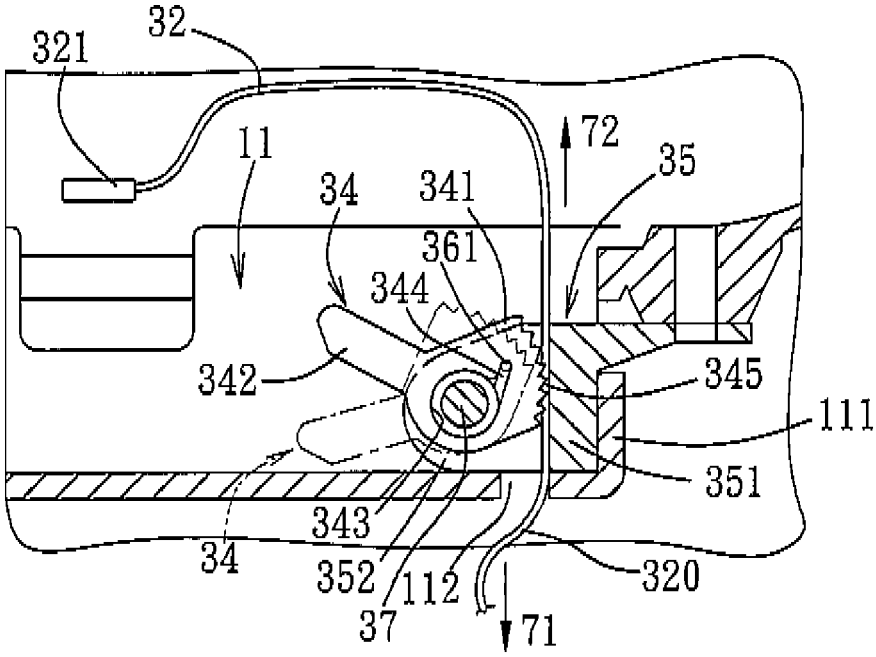
FIG. 5 is a fragmentary schematic sectional view of a strap with an end segment disposed to be received in a receiving cavity and a brake mechanism operable to engage the strap, according to the first preferred embodiment.
Figure 6:
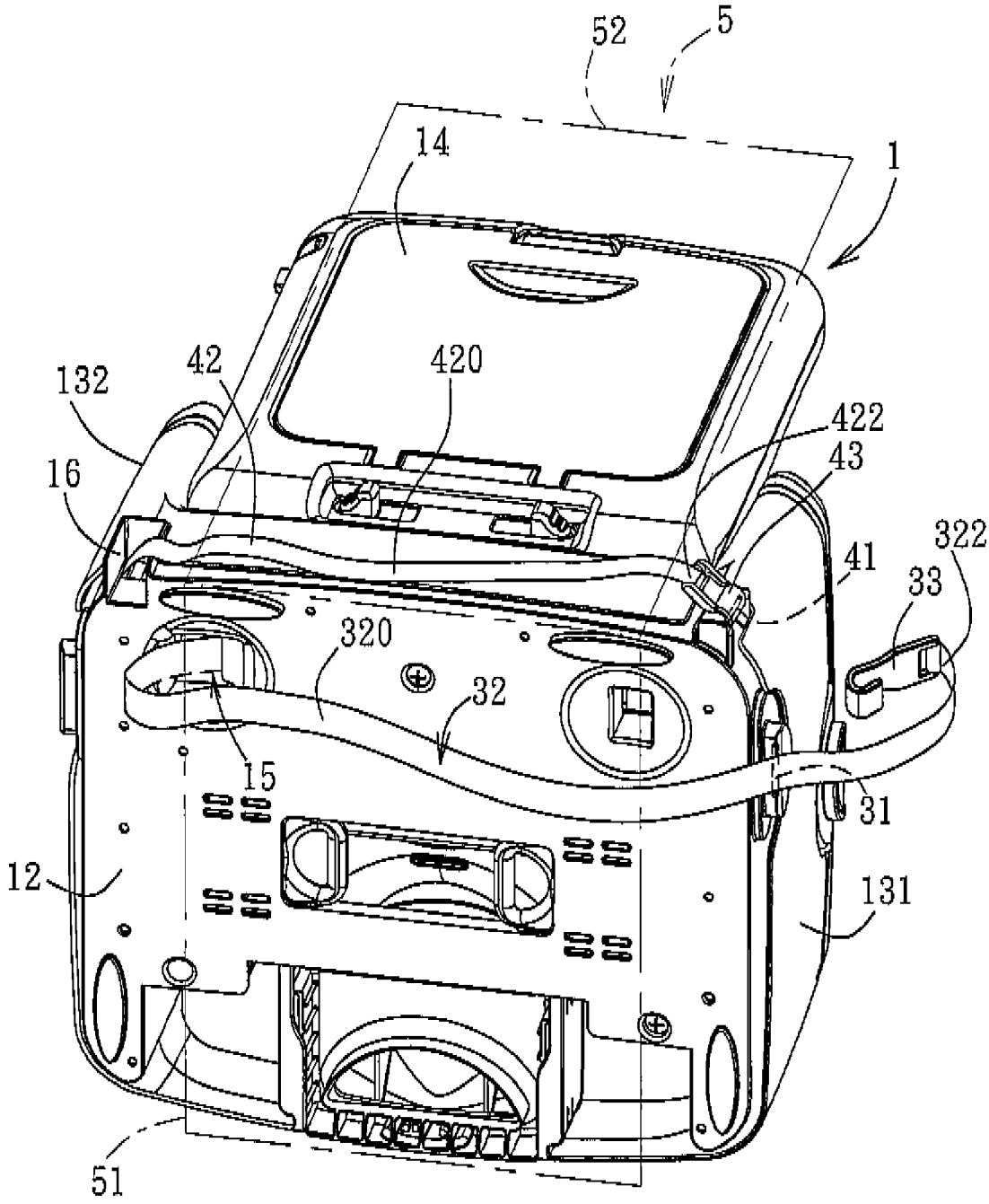
FIG. 6 is an additional perspective view of the child booster seat, according to the first preferred embodiment.

As shown in FIGS. 5 and 6, the first strap 32 includes a first end segment 321 and a second end segment 322, each of which may include an end of the first strap 32 and a part of the first strap 32 proximate to the end of the first strap 32. In this embodiment, the first end segment 321 of the first strap 32 has a thickness sufficient to prevent the first end segment 321 from passing through a first strap passage, which may be composed of the space between the contact surface 345 of the cam portion 341 of the first operating component 34 and the base plate 351 of the first pivot base 35 and/or the cavity wall 111.

The first end segment 321 is retained in the receiving cavity 11. For example, the first end segment 321 may be stored within the receiving cavity 11, pulled relative to the receiving cavity 11 to adjust the first strap 32, fastened within the receiving-cavity 11, or held within the receiving cavity 11 to prevent the first strap 32 from being extracted through the first strap passage.

The first strap 32 further includes a first middle segment 320 extending between the first end segment 321 and the second end segment 322. The first middle segment 320 of the first strap 32 extends the first strap passage, through the first opening 112 of the upper housing part 17 of the seat member 12, and through the first hole 15 formed on the lower housing part 18 of the seat member 12 of the seat body 1 to extend outwards. The first end segment 321 is thus disposed to be received in the receiving cavity 11 and the first coupling member 33 is disposed outwardly of the receiving cavity 11.

The first coupling member 33 is connected to the second end segment 322 of the first strap 32. In this embodiment, the first coupling member 33 has a hook structure to engage the rod structure of the first anchor portion 31. Alternatively, the first coupling member 33 may have a rod structure that is engageable with a hook structure of the first anchor portion 31. Other structures for releasable engagement between the first coupling member 33 and the first anchor portion 31 may be used to accomplish the same or a similar effect.

In this embodiment, each of the first biasing members 36 is a torsion spring sleeved on the first pivot axle 37 and disposed on the respective end of the first operating component 34. Each of the first biasing members 36 has one end 361 fixed in a respective positioning slot 344 of the first operating component 34 and the other end 362 hooked to a respective pivot connection lug 352 of the first pivot base 35. Preferably, each of the pivot connection lugs 352 is formed with a notch 353 to provide a hooking point for the other end 362 of a corresponding first biasing member 36.

Through the disposition of the first biasing members 36, the first operating component 34 is biased towards a clamping position where the contact surface 345 of the cam portion 341 clamps the first middle segment 320 of the first strap 32 against the cavity wall 111 and/or the base plate 351 to arrest movement of the first middle segment 320 relative to the seat body 1 towards the first opening 112 when the second end segment 322 is pulled. The first operating component 34 is movable between the clamping position and a releasing position where the cam portion 341 permits movement of the first middle segment 320 of the first strap 32 through the first opening 112.

Figure 2:
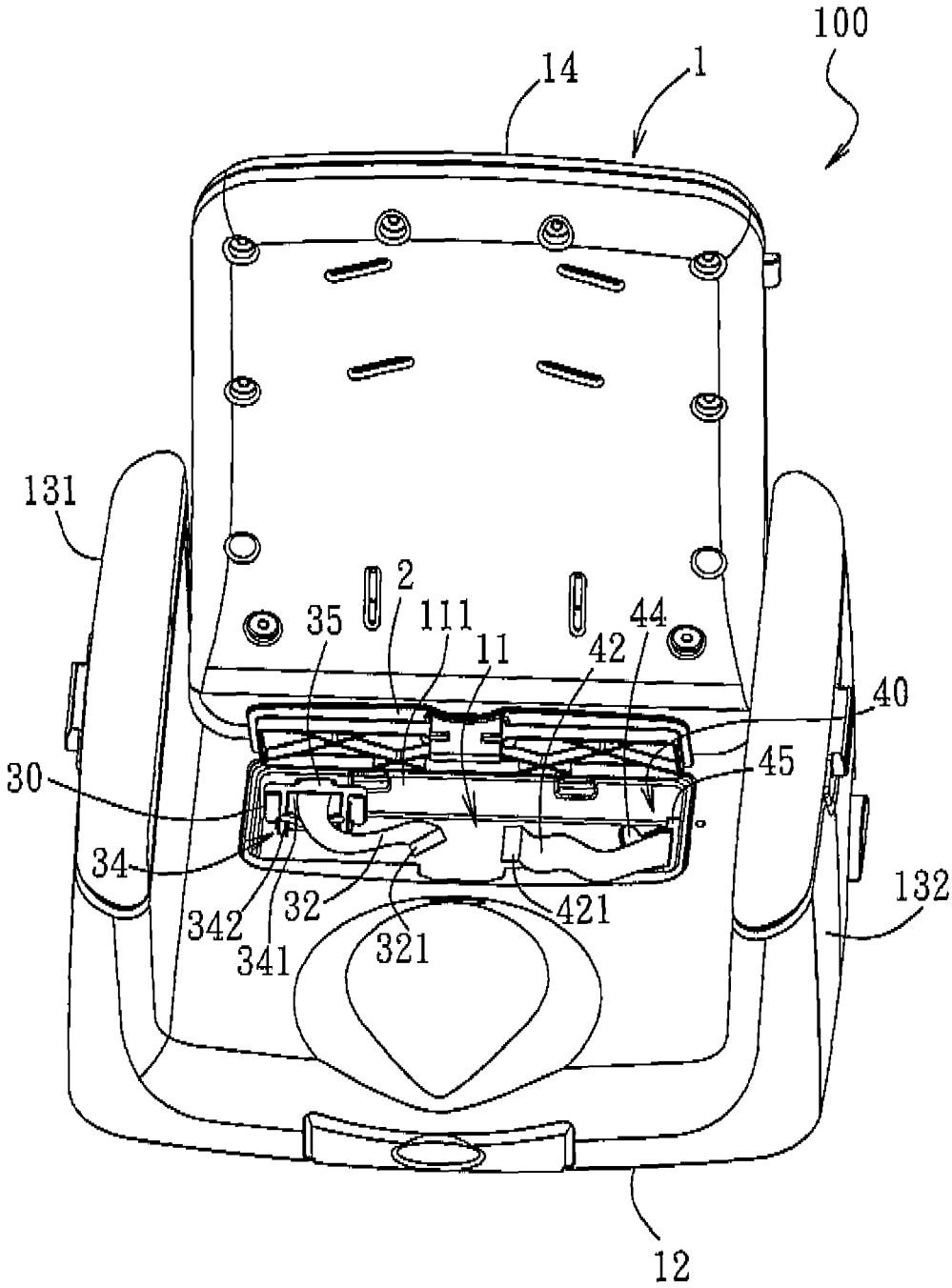
FIG. 2 is another perspective view of the child booster seat, according to the first preferred embodiment.
Figure 3:
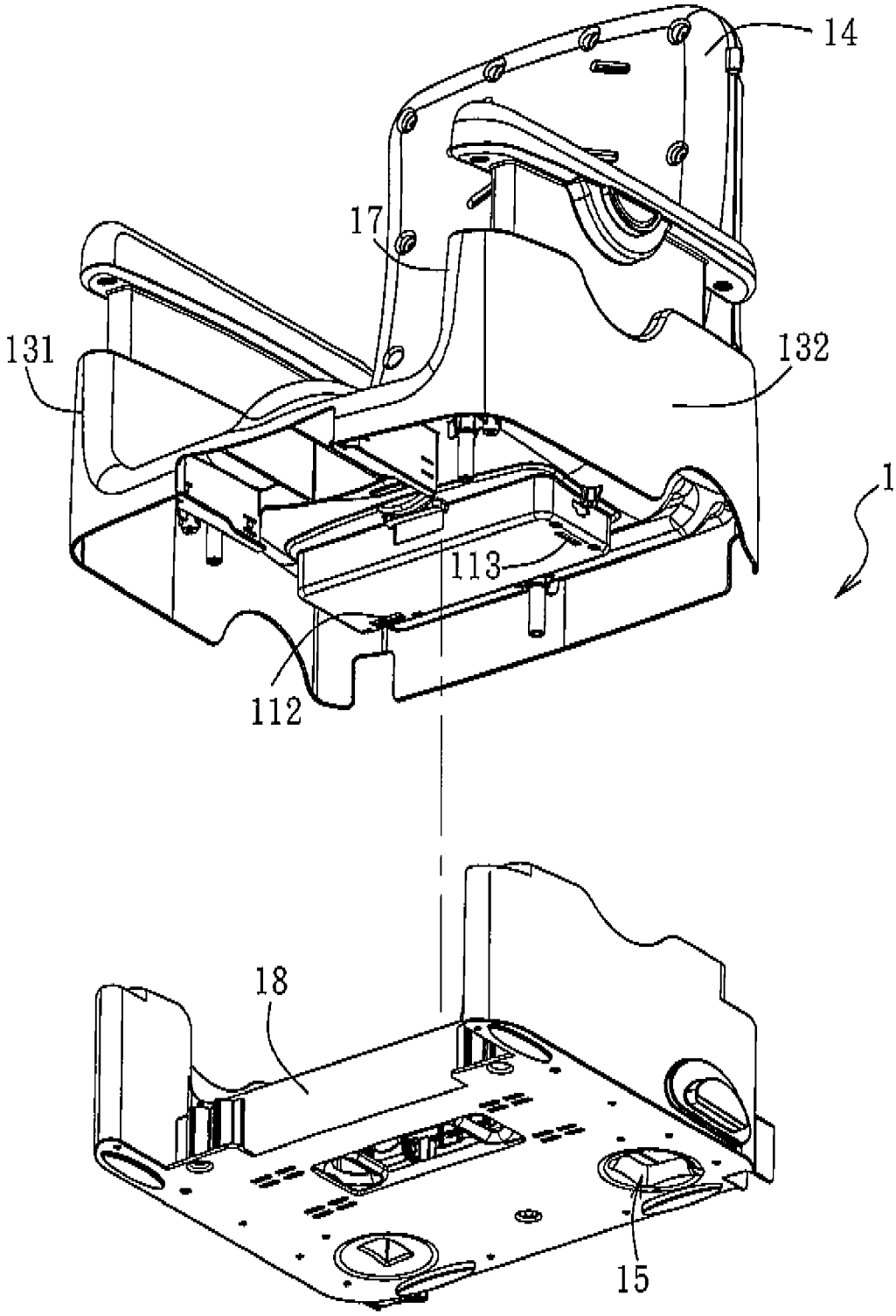
FIG. 3 is an exploded perspective view of the child booster seat, according to the first preferred embodiment.

In this embodiment, the second strap 42 has a component that corresponds to each of the components associated with the first strap 32 with similar structure and relative disposition, as illustrated in FIGS. 2, 4B, and 6. For example, the first anchor portion 31, the first coupling member 33, the first operating component 34, the first pivot base 35, the pair of first biasing members 36, and the first pivot axle 37, correspond respectively to the second anchor portion 41, the second coupling member 43, the second operating component 44, the second pivot base 45, the pair of second biasing members 46, and the second pivot axle 47. In addition, rear side of the first and second side member 131, 132 of the seat body 1 is formed with a second hole 16 and the second anchor portion 41, which are spaced apart from each other, respectively.

The second pivot base 45 is disposed on the cavity wall 111 of the receiving cavity 11 and adjacent to the second opening 113 (similar to the first pivot base 35 being disposed adjacent to the first opening 112). The second pivot base 45 is mounted fixedly to the cavity wall 111 of the receiving cavity 11 through a base plate of the second pivot base 45 such that pivot connection lugs of the second pivot base 45 are disposed in the receiving cavity 11.

As shown in FIG. 4B, the second operating component 44 has a second cam portion 491 that includes a teethed contact surface. The second cam portion 991 of the second operating component 44 is pivotably connected with the second pivot base 45 by extending the second pivot axle 47 through the pivot connection lugs of the second pivot base 45 and a pivot connection hole of the second operating component 44.

As shown in FIGS. 2 and 6, the second strap 42 has a third end segment 421 and a fourth end segment 922, each of which may include an end of the second strap 42 and a part of the second strap 42 proximate to the end of the second strap 42. In this embodiment, the third end segment 421 of the second strap 42 has a thickness sufficient to prevent the third end segment 421 from passing through a second strap passage, which is composed of the space between the second cam portion 441 of the second operating component 44 and the base plate of the second pivot base 45 and/or the cavity wall 111. The third end segment 421 is retained in the receiving cavity 11.

The second strap 92 further includes a second middle segment 420 extending between the third end segment 421 and the fourth end segment 422. The second middle segment 420 of the second strap 42 extends through the second strap passage, through the second opening 113 of the upper housing part 17 of the seat member 12, and through the second hole 16 of the seat member 12 of the seat body 1 to extend outwards. The second coupling member 43, which has a hook structure engageable with the rod structure of the second anchor portion 41, is connected to the fourth end segment 422 of the second strap 42. The third end segment 921 is thus disposed to be received in the receiving cavity 11, and the second coupling member 43 is disposed outwardly of the receiving cavity 11.

Each of the second biasing members 96 is a torsion spring sleeved on the second pivot axle 47 and disposed at a respective end of the second operating component 44. Through the disposition of the second biasing members 46, the second operating component 44 is biased towards a clamping position where the contact surface of the second cam portion 491 clamps the second middle segment 420 of the second strap 42 against the cavity wall 111 and/or the base plate of the second pivot base 45 to arrest movement of the second middle segment 420 relative to the seat body 1 towards the second opening 113 when the fourth end segment 422 is pulled. The second operating component 44 is operable between the clamping position and a releasing position where the second cam portion 441 of the second operating component 44 permits movement of the second middle segment 420 of the second strap 42 through the second opening 113.

To bind the seat body 1 to the chair 5, the cover 2 is opened to permit access to the receiving cavity 11. Using the first strap 32 as an example, while the first brake mechanism 30 is in the clamping position, movement of the first strap 32 relative to the seat body 1 is arrested. In this embodiment, the first brake mechanism 30 includes a cam portion 341 that clamps the first middle segment 320 of the first strap 32 against the cavity wall 111 such that pulling the second end segment 322 urges the cam portion 341 toward a tighter clamping position so as to arrest the first strap 32 moving. Pulling the first end segment 321, on the other hand, urges the cam portion 341 away from the tighter clamping position and toward the releasing position, so that user does not have to operate the first operating component 34 to adjust the exposed length of the first strap 32. When the first brake mechanism 30 reaches the tighter clamping position, the cam portion 341 does not move.

In order to extend the first strap 32 on one side of a chair part, the first brake mechanism 20 is disengaged by pressing the extension portion 342 of the first operating component 34 to convert the first brake mechanism 30 into a releasing state. While the first brake mechanism 30 is disengaged, the second end segment 322 may be pulled to draw the first middle segment 320 of the first strap 32 through the first strap passage, through the first opening 112, and the first hole 15 (e.g., in the direction indicated by the arrow 71 of FIG. 5). The first middle segment 320 of the first strap 32 may then be extended around the chair part, such as a seat part 51, a back part 52, a supporting rod, an armrest, or other structure of the chair 5. Preferably, the thickness of the first end segment 321 is sufficient to prevent the first end segment 321 from being drawn through the first strap passage, thus retaining the first end segment 321 in the receiving cavity 11.

After the first middle segment 320 has been extended around the chair part, the first coupling member 33 is engaged with the first anchor portion 31 of the seat body 1. The extension portion 342 of the first operating component 34 may then be released to allow the first biasing members 36 to convert the first brake mechanism 30 to the clamping position.

The first end segment 321 may then be pulled to adjust the exposed length of the first middle segment 320 extending outwards from the first hole 15. Pulling the first end segment 321 may then draw the first middle segment 320 of the first strap 32 into the seat body 1, through the first hole 15, and the first opening 112 (e.g., in the direction indicated by the arrow 72 of FIG. 5). Pulling the first end segment 321 may also move the first brake mechanism 30 away from a tighter clamping position, allowing the first strap 32 to be adjusted until the seat body 1 is firmly bound to the chair 5.

Similarly, the second strap 42 may be adjusted by pressing the extension portion of the second brake mechanism 40 to convert it to a releasing position and pulling the fourth end segment 422. The second middle segment 420 of the second strap 42 may then be extended around a chair part, and the second coupling member 43 may be attached to the second anchor portion 41 of the seat body 1. The extension portion of the second brake mechanism 40 may then be released, and the third end segment 421 may be pulled to tighten the second middle segment 420 around the part of chair 5 and to bind the seat body 1 to the chair 5 using the second strap 42. In this embodiment, the first strap 32 is used to bind the child booster seat 100 to the seat part 51 and the second strap 42 is used to bind the child booster seat 100 to the back part 52. The first strap 32 and the second strap 42 may bind the seat body 1 to the same or different chair parts.

The straps 32, 42 of the child booster seat 100 may be operated in other ways to secure the seat body 1 to the chair 5. In addition, the child booster seat 100 may include only one of the first strap 32 and the second strap 42 or multiple additional straps.

The child booster seat 100 is released from the chair 5 by disengaging the first strap 32 and the second strap 92 from the first anchor portion 31 and the second anchor portion 41, respectively. The first end segment 321 of the first strap 32 and the third end segment 421 of the second strap 42 are then pulled away relative to the first hole 15 and the second hole 16 respectively such that the first middle segment 320 of the first strap 32 and the second middle segment 420 of the second strap 42 are pulled into and received within the receiving cavity 11. The receiving cavity 11 thus provides a storage to receive the first strap 32 and the second strap 42. The first coupling member 33 and the second coupling member 43 are received at recessed locations adjacent to the first hole 15 and the second hole 16, respectively.

The first hole 15 and the second hole 16 are formed in the lower housing part 18 rather than the upper housing part 17. The first anchor portion 31 and the second anchor portion 41 are mounted to the lower housing part 18 rather than the upper housing part 17. Accordingly, when the first strap 32 is extended around a seat part 51 of a chair 5, and the second strap 42 is extended around a back part 52 of the chair 5, the upper housing part 17 may be raised or lowered without releasing the first strap 32 or the second strap 42.

Figure 7:
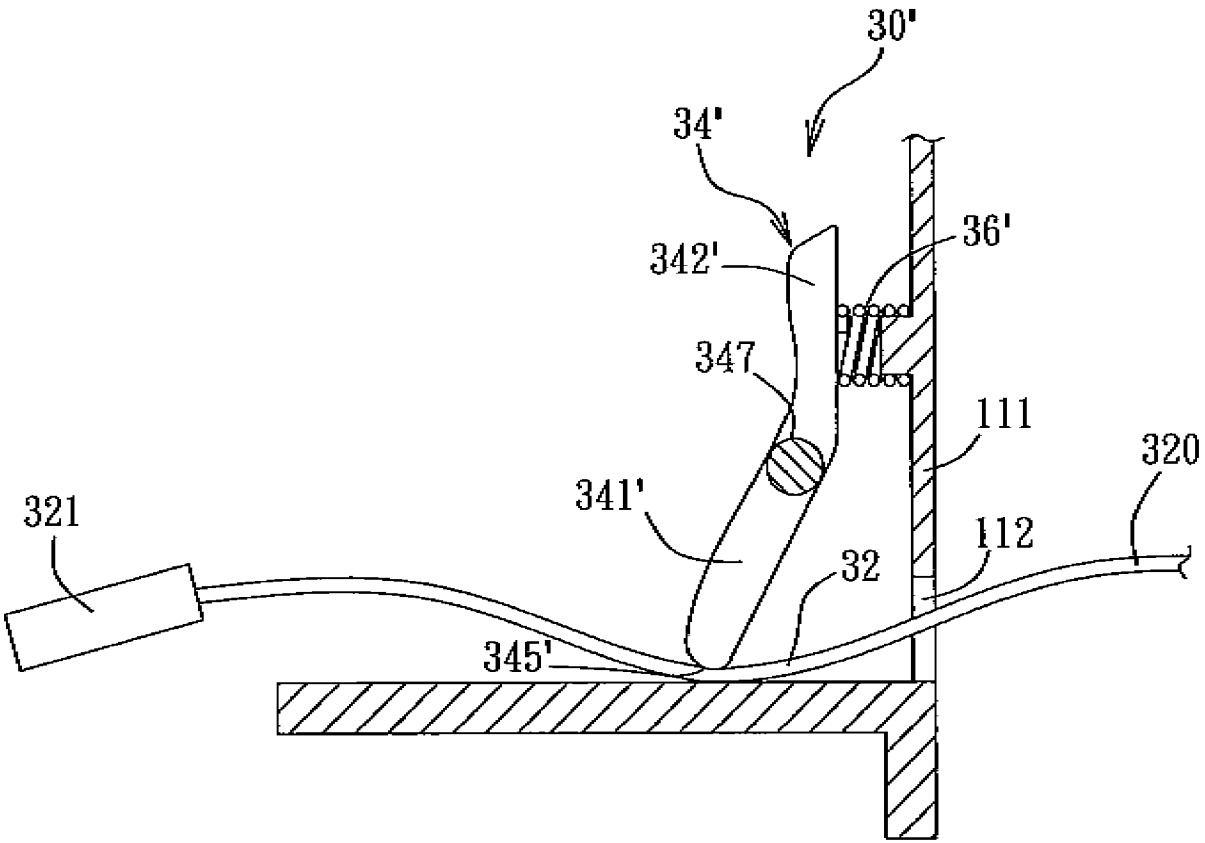
FIG. 7 is a fragmentary schematic sectional view of the strap with the end segment disposed to be received in the receiving cavity and a brake mechanism operable to engage the strap, according to a variation of the first preferred embodiment.

In FIG. 7, a modification of the first brake mechanism 30' of the first preferred embodiment is shown. The cross sectional view of the first operating component 34' has an elongated shape, and the contact surface 345' of the first operating component 34' has a tapered tip edge.

The first operating component 34' further includes an intermediate pivot connection portion 347 disposed between the cam portion 341' and the extension portion 342' for mounting the first operating component 34' pivotably to the cavity wall 111. Alternatively, the first operating component 34' may be pivotably mounted using the structure of the first pivot base 35 as in the first embodiment. The first biasing member 36' is a compression spring located between the extension portion 342' and the seat body 1.

The first biasing member 36' biases the cam portion 341' towards the clamping position. At the clamping position, the contact surface 345' of the first operating component 34' abuts against the first middle segment 320 of the first strap 32 to clamp it to the seat body 1 and to arrest movement of the first strap 32 relative to the seat body 1. The extension portion 342' may be pressed to move the first operating component 34' to the releasing position, which allows the second end segment 322 to be pulled to extend the first middle segment 320 of the first strap 32 around a chair part. When the first end segment 321 of the first strap 32 is pulled, the first operating component 34' is moved away from the clamping position, allowing the first middle segment 320 of the first strap 32 to be tightened around the chair part without using the extension portion 342' to disengage the first brake mechanism 30'.

Figure 8:
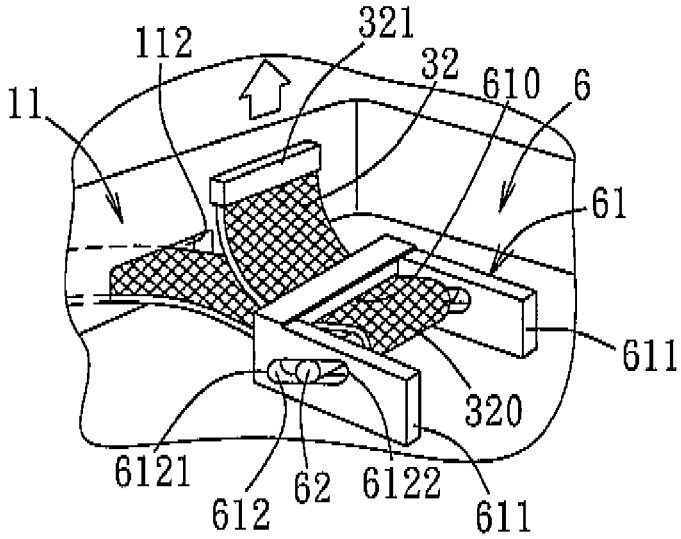
FIG. 8 is a fragmentary perspective view of the strap with the end segment disposed to be received in the receiving cavity and a brake mechanism operable to engage the strap, according to yet another variation of the first preferred embodiment.
Figure 9:
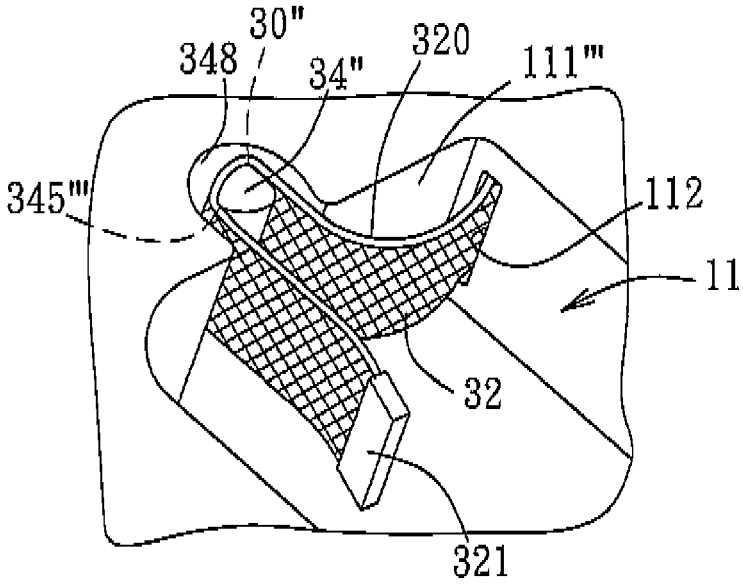
FIG. 9 is a fragmentary perspective view of the strap with the end segment disposed to be received in the receiving cavity and a brake mechanism operable to engage the strap, according to a further variation of the first preferred embodiment.

Referring to FIGS. 8 and 9, additional modifications of a first brake mechanism 6 are shown to differ from the first version of the first brake mechanism 6 primarily in the curved path followed by the first strap 32. In FIG. 8, the additional modification of the first preferred embodiment is shown to include a slider seat 61 and a first operating component 62. The first operating component 62 is a slider rod 62 in this embodiment. The slider seat 61 is mounted in the receiving cavity 11, and includes a pair of spaced apart slider walls 611 and an end wall coupled to the slider walls 611 and formed with a strap slot 610 that faces the first opening 112.

Each of the slider walls 611 is formed with a slider groove 612 that is inclined relative to the cavity wall of the receiving cavity and having a near end 6121 and a far end 6122 that are respectively proximate to and distal from the strap slot 610. The near end 6121 is lower than the far end 6122. The first strap passage may be the space between the slider rod 62 and the seat body 1. Preferably, the distance between the near end 6121 of the slider groove 612 and the cavity wall 111 of receiving cavity 11 is smaller than the thickness of the first strap 32.

The slider rod 62 has a pair of ends, each mounted in a respective slider groove 612 and slidable relative to the slider seat 61. The first middle segment 320 of the first strap 32 may be passed through the strap slot 610 and looped around the slider rod 62, pass through the first opening 112 and into the seat body 1, and out of the seat body 1 through the first hole 15 (see FIG. 6).

When the second end segment 322 of the first strap 32 is pulled, the slider rod 62 is moved towards a clamping position where it is at the near end 6121 of the slider groove 612 such that the slider rod 62 clamps the first middle segment 320 of the first strap 32 against the cavity wall 111 and/or another fixed surface, such as part of the slider seat 61. Clamping the first middle segment 320 arrests movement of the first strap 32, thus allowing the first end segment 321 to be retained in the receiving cavity 11.

In order to tighten the first middle segment 320 of the first strap 32 around a chair part or to adjust the length of the first middle segment 320 extending outwards from the first hole 15, the first brake mechanism 6 may first be moved from the clamping position to a releasing position. The slider rod 62 may be moved away from the near end 6121 to release the first middle segment 320 from being clamped between the slider rod 62 and an adjacent fixed surface, such as the cavity wall 111, the seat body 1, or a part of the slider seat 61. The slider rod 62 may be pulled or pushed directly, or the first end segment 321 may be removed from the strap slot 610 and pulled to move the slider rod 62 away from the near end 6121.

Referring to FIG. 9, in yet another modification of the first preferred embodiment, a first brake mechanism 30" is shown to include a columnar operating portion 34" disposed adjacent to a restriction wall 111'", which may include part of the seat body 1, the cavity wall 111, or the first brake mechanism 30". The columnar operating portion 34" and the restriction wall 111'" cooperate to define an embedding groove 348 in which the first middle segment 320 of the first strap 32 may be removably embedded to engage the first brake mechanism 30" and to arrest movement of the first strap 32.

Preferably, the embedding groove 348 is curved, and the columnar operating portion 34" includes a peaked contact surface 345'" opposite to the first opening 112 for restricting movement of the first strap 32. The first middle segment 320 of the first strap 32 may be uprooted from the embedding groove 348 to disengage the first brake mechanism 30" and to allow adjustment of the first strap 32. The first strap passage is the portion of the embedding groove 348 distal to the first opening 112.

Figure 10:
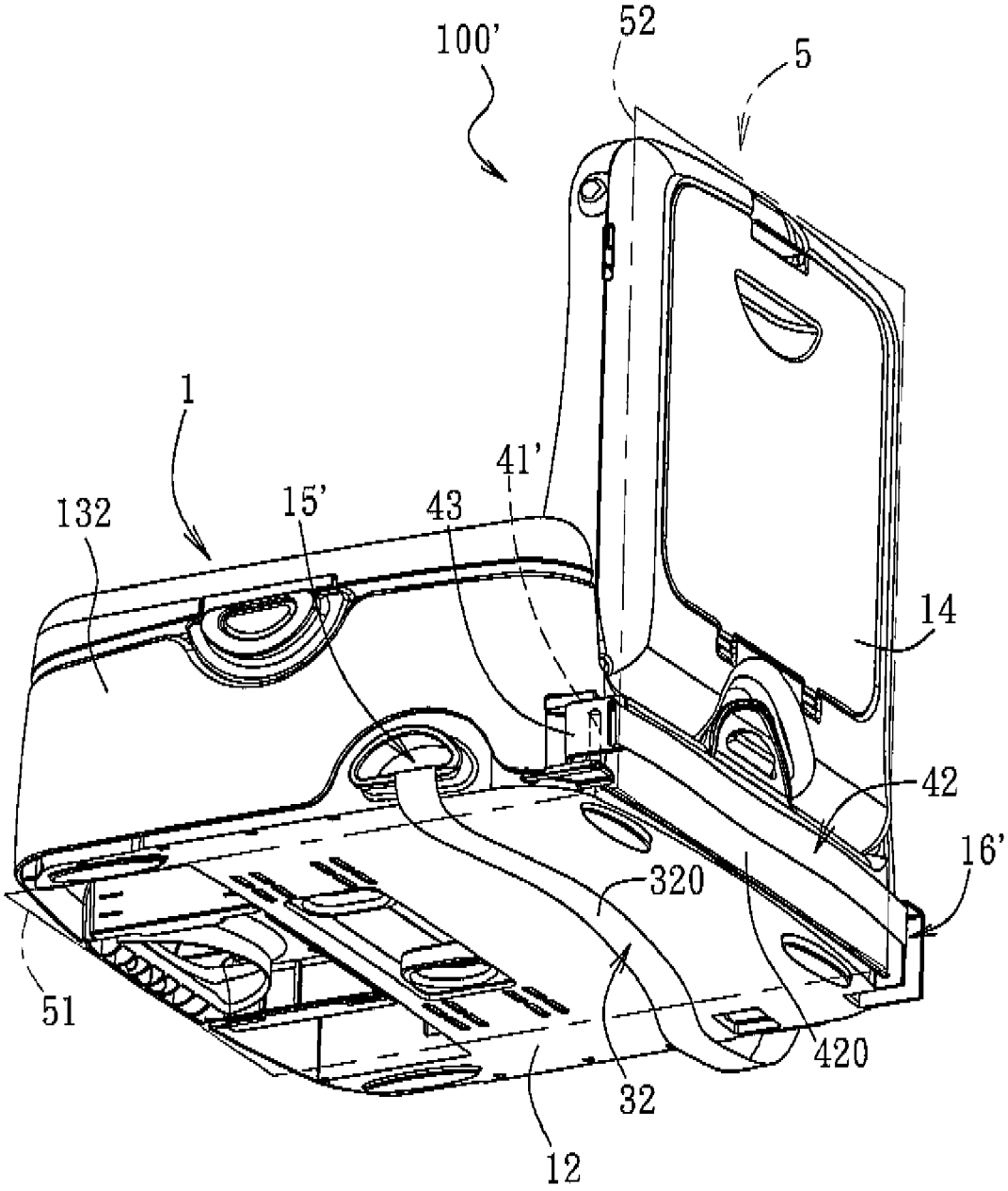
FIG. 10 is a perspective view of the child booster seat, according to the second preferred embodiment of the present invention.
Figure 11:
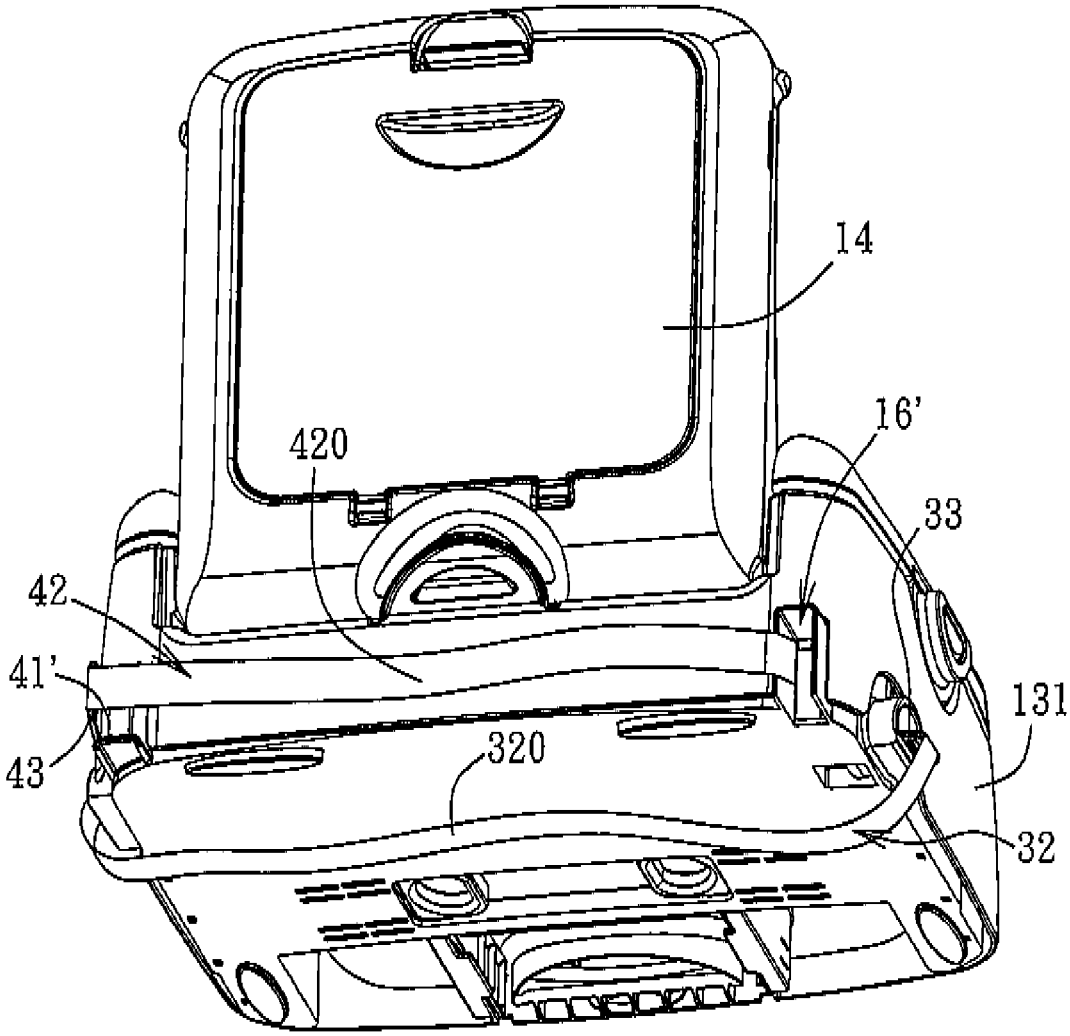
FIG. 11 is another perspective view of the child booster seat, according to the second preferred embodiment of the present invention.

Referring to FIGS. 10 and 11, the second preferred embodiment of the child booster seat 100' according to the present invention is shown to differ from the first preferred embodiment in that the first hole 15' is formed in the side of the seat body 1 corresponding to the second side member 132 at a location adjacent to the seat member 12. As in the first preferred embodiment, the first anchor portion 31 is mounted to the side of the seat body 1 corresponding to the first side member 131. In this manner, the first hole 15' and the first anchor portion 31 are disposed on the sides of the seat body 1 corresponding to the first side member 131 and the second side member 132.

A rear section of the seat body 1 is formed with a second hole 16' disposed correspondent to the first side member 131 rather than the second side member 132. Similarly, the second anchor portion 41' is mounted on a rear side of the seat body 1 correspondent to the second side member 132 rather than the first side member 131.

In variations of these embodiments, the positions of the second hole 16' and the second anchor portion 41' may be switched and/or the positions of the first hole 15' and the first anchor portion 31 may be switched. Furthermore, the first hole 15', the first anchor portion 31, the second hole 16', and the second anchor portion 41' may each be located on the first side member 131, the second side member 132, the backrest member 19, or the seat member 12. In these examples, the first middle segment 320 of the first strap 32 and the second middle segment 920 of the second strap 92 may still be extended around various parts of a chair 5 to bind the seat body 1 to the chair 5.

The receiving cavity 11 may be accessible from an upper surface of the seat body 1. For example, the receiving cavity 11 may be installed in the seat member 12, the first or second side member 131 or 132, or the backrest member 14. The receiving cavity 11 may thus open towards a top surface of the seat member 12, or an exterior wall of one of the side members 131 and 132 or the backrest member 19 of the seat body 1. The receiving cavity 11 may further be in spatial communication with an additional opening in an upper surface of the seat body 1 that allows access to the first strap 32 or the second strap 42.

The first brake mechanism 30 and/or the second brake mechanism 40 may be contained within the receiving cavity 11. The first brake mechanism 30 and/or the second brake mechanism 40 may clamp releasably the first strap 32 or the second strap 42 against the seat body 1. For example, the first brake mechanism 30 may be mounted to the seat body 1. The first brake mechanism 30 may further include a clamp that presses the first strap 32 against a part of the seat body 1 outside of the receiving cavity 11 or against an additional part of the first brake mechanism 30, such as the base plate 351.

In sum, through the disposition of the first strap 32, the second strap 42, and the receiving cavity 11 of the seat body 1, the seat body 1 may be bound to the chair 5, and the first strap 32 and the second strap 42 may be received in the seat body 1 for storage and access purposes.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A child booster seat for use with a chair, comprising:

a seat body having a cavity wall that confines a receiving cavity and that is formed with a first opening;

a first strap including a first end segment and a second end segment, a first coupling member attached to said second end segment, said first strap being configured to couple with said seat body in a manner that said first end segment is retained in said receiving cavity and that said second end segment is disposed to be extended through said first opening in said seat body to dispose said first coupling member outwardly of said receiving cavity, said first coupling member being connected releasably to said seat body so that said first strap is operable to bind said seat body to the chair; and a first brake mechanism mounted to said seat body and configured to engage said first strap for arresting movement of said first strap relative to said seat body;

wherein said first brake mechanism defines a strap passage for passage of said first strap, said first end segment of said first strap having a thickness sufficient to prevent said first end segment from passing through said first strap passage;

wherein said seat body includes an upper housing part and a lower housing part, said receiving cavity being formed in said upper housing part, said second end segment of first strap being disposed to be extended through said first opening and said lower housing part.

2. The child booster seat as claimed in claim 1, wherein said first brake mechanism includes a first operating component movable relatively to the seat body for clamping releasably said first strap against said seat body.

3. The child booster seat as claimed in claim 2, wherein said first strap is freely movable relative to the seat body without operating the first operating component when the first end segment is pulled.

4. The child booster seat as claimed in claim 2, wherein said first operating component is pivotal relative the seat body between a clamping position where said first operating component clamps said first strap against said seat body to arrest movement of the first strap, and a releasing position where said first strap is permitted to move.

5. The child booster seat as claimed in claim 2, the first operating component having a cam portion for clamping the first strap relative to the seat body.

6. The child booster seat as claimed in claim 5, wherein said first operating component further has an extension portion that is connected to said cam portion and that is operable to convert said first operating component from the clamping position to the releasing position.

7. The child booster seat as claimed in claim 5, wherein said cam portion has a teethed contact surface for contacting said first strap.

8. The child booster seat as claimed in claim 5, wherein said cam portion has a tapered tip edge.

9. The child booster seat as claimed in claim 2, wherein said first operating component is slidable relative to the seat body between a clamping position where said first operating component clamps said first strap against said seat body to arrest movement of the first strap, and a releasing position where said first strap is permitted to move.

10. The child booster seat as claimed in claim 9, wherein said first brake mechanism includes a slider seat mounted in said receiving cavity, and the first operating component is a slider rod mounted slidably to an inclined slider groove of said slider seat, said first strap being looped around said slider rod.

11. The child booster seat as claimed in claim 1, wherein said first brake mechanism is formed with an embedding groove for embedding removably a part of said first strap therein.

12. The child booster seat as claimed in claim 11, wherein said first brake mechanism includes a columnar operating portion and a restriction wall provided on said seat body adjacent to said operating portion, said operating portion cooperating with said restriction wall to define said embedding groove.

13. The child booster seat as claimed in claim 1, wherein said first strap further includes a first middle segment, said seat body includes a seat member, and a side member and a backrest member coupled to said seat member, one of said side member, a bottom side of said seat member and said backrest member being formed with a first hole through which said first middle segment of said first strap extends.

14. The child booster seat as claimed in claim 1, wherein said cavity wall is further formed with a second opening and said child booster seat further comprises:

a second strap including a third end segment, and a fourth end segment, and a second coupling member attached to said fourth end segment, said second strap being configured to couple with said seat body in a manner that said third end segment is retained in said receiving cavity and that said fourth end segment is disposed to be extended through said second opening in said seat body to dispose said second coupling member outwardly of said receiving cavity, said second coupling member being connected releasably to said seat body so that said second strap is operable to bind said seat body to the chair; and a second brake mechanism mounted to said seat body and configured to engage said second strap for arresting movement of said second strap relative to said seat body.

15. A child booster seat for use with a chair, comprising:

a seat body having a cavity wall that confines a receiving cavity and that is formed with a first opening;

a first strap including a first end segment and a second end segment, a first coupling member attached to said second end segment, said first strap being configured to couple with said seat body in a manner that said first end segment is retained in said receiving cavity and that said second end segment is disposed to be extended through said first opening in said seat body to dispose said first coupling member outwardly of said receiving cavity, said first coupling member being connected releasably to said seat body so that said first strap is operable to bind said seat body to the chair; and a first brake mechanism mounted to said seat body and configured to engage said first strap for arresting movement of said first strap relative to said seat body;

wherein said first brake mechanism defines a strap passage for passage of said first strap, said first end segment of said first strap having a thickness sufficient to prevent said first end segment from passing through said first strap passage;

wherein said seat body has a first anchor portion, one of said first anchor portion and said first coupling member being formed with a hook structure, the other one of said first anchor portion and said first coupling member being formed with a rod structure, the hook structure being configured to hook onto the rod structure to attach said first coupling member to said first anchor portion.

16. The child booster seat as claimed in claim 1, wherein said receiving cavity is accessible from an upper side of said seat body and contains said first brake mechanism.

17. A child booster seat, comprising:

a seat body including a receiving cavity;

a first strap including a first end segment retained within the receiving cavity and a second end segment is extended outwardly of said receiving cavity, and a first brake mechanism mounted within the receiving cavity to clamp releasably said first strap against said seat body;

wherein said first brake mechanism defines a strap passage for passage of said first strap, said first end segment of said first strap having a thickness sufficient to prevent said first end segment from passing through said first strap passage;

wherein said seat body includes an upper housing part and a lower housing part, said receiving cavity being formed in said upper housing part, said second end segment of first strap being disposed to be extended through said first opening and said lower housing part.

18. The child booster seat as claimed in claim 17, wherein said first brake mechanism is accessible from an upper side of said seat body.

19. The child booster seat as claimed in claim 17, wherein said seat body has a first anchor portion, and the second end segment is connected to a first coupling member, said coupling member is connected releasably to said first anchor portion.

20. The child booster seat as claimed in claim 17, wherein said first brake mechanism includes a first operating component movable relatively to the seat body for clamping releasably said first strap against said seat body, said first strap being moved freely relative to the seat body when the first end segment is pulled and being clamped relative to the seat body when the second end segment is pulled.

* * * * *